US012656057B2

(12) United States Patent
Knoche

(10) Patent No.: US 12,656,057 B2
(45) Date of Patent: Jun. 16, 2026

(54) CRYOGENIC GAS COOLING SYSTEM AND METHOD

(71) Applicant: Chart Energy & Chemicals, Inc., Ball Ground, GA (US)

(72) Inventor: Martin Knoche, Oberstammheim (CH)

(73) Assignee: Chart Energy & Chemicals, Inc., Ball Ground, GA (US)

( * ) Notice: Subject to any disclaimer, the term of this patent is extended or adjusted under 35 U.S.C. 154(b) by 259 days.

(21) Appl. No.: 18/634,552

(22) Filed: Apr. 12, 2024

(65) Prior Publication Data

US 2024/0377127 A1 Nov. 14, 2024

Related U.S. Application Data

(60) Provisional application No. 63/495,681, filed on Apr. 12, 2023.

(51) Int. Cl.
*F25J 1/02* (2006.01)
*F25J 1/00* (2006.01)

(52) U.S. Cl.
CPC ..... *F25J 1/0209* (2013.01); *F25J 1/001* (2013.01); *F25J 1/0067* (2013.01); *F25J 1/0072* (2013.01);
(Continued)

(58) Field of Classification Search
CPC .. F25J 1/001; F25J 1/005; F25J 1/0052; F25J 1/0057; F25J 1/0067; F25J 1/0072; F25J 1/0082; F25J 1/0205; F25J 1/0209; F25J 1/0221; F25J 1/0247; F25J 1/0254; F25J 1/0291; F25J 1/0292; F25J 2205/60; F25J 2210/04; F25J 2210/62; F25J 2230/60; F25J 2235/60; F25J 2240/30; F25J 2240/60; F25J 2245/02; F25J 2250/02; F25J 2270/04;
(Continued)

(56) References Cited

U.S. PATENT DOCUMENTS 4,637,216 A * 1/1987 Shenoy ..... F25J 1/0258 62/47.1
12,163,736 B2 * 12/2024 Han ..... F25J 1/0288
(Continued)

FOREIGN PATENT DOCUMENTS

CN 113280523 A 8/2021
CN 217785512 U 11/2022
JP 2007057156 A 3/2007

*Primary Examiner* — Filip Zec
(74) *Attorney, Agent, or Firm* — Edell, Shapiro & Finnan, LLC

(57) ABSTRACT

A precool heat exchanger system receives a stream of first cryogenic fluid for warming a second cryogenic fluid. A first splitter receives and divides a first cryogenic fluid stream into a motive stream and a secondary cooling stream. An ejector receives the motive stream. An expansion device receives and expands the secondary cooling stream and directs at least a portion of it to the precool heat exchanger system so that a second cryogenic fluid is cooled. First cryogenic fluid from the precool heat exchanger is directed into the ejector suction port and the pressure therein is reduced. A primary separation device divides a first cryogenic fluid mixed phase stream from the ejector into a first cryogenic fluid vapor stream and a liquid recycle stream that exit the primary separation device. A recycle pump directs first cryogenic fluid to the first splitter.

32 Claims, 3 Drawing Sheets

(52) U.S. Cl.
CPC ..... *F25J 1/0082* (2013.01); *F25J 1/0291* (2013.01); *F25J 1/0292* (2013.01); *F25J 2205/60* (2013.01); *F25J 2240/60* (2013.01); *F25J 2245/02* (2013.01); *F25J 2270/04* (2013.01); *F25J 2270/20* (2013.01); *F25J 2270/60* (2013.01)

(58) Field of Classification Search
CPC .. F25J 2270/16; F25J 2270/18; F25J 2270/20; F25J 2270/60
See application file for complete search history.

(56) References Cited

U.S. PATENT DOCUMENTS

| | | | | |
|---|---|---|---|---|
| 12,366,331 | B2 * | 7/2025 | Aoun | F02M 21/0215 |
| 2013/0111944 | A1 * | 5/2013 | Wang | F25B 43/006 62/500 |
| 2013/0277448 | A1 * | 10/2013 | Liu | F25B 49/02 239/11 |
| 2016/0033183 | A1 | 2/2016 | Kawano et al. | |
| 2016/0215930 | A1 * | 7/2016 | Nelson | B63B 25/16 |
| 2018/0003429 | A1 * | 1/2018 | Mak | F25J 1/0208 |
| 2018/0022432 | A1 * | 1/2018 | Lee | F02M 21/06 123/495 |
| 2020/0239109 | A1 * | 7/2020 | Lee | F25J 1/0025 |
| 2021/0270522 | A1 * | 9/2021 | Molter | B01D 53/326 |
| 2022/0082210 | A1 | 3/2022 | Decker et al. | |
| 2023/0251030 | A1 * | 8/2023 | Guenego | F25J 1/001 62/613 |

* cited by examiner

CRYOGENIC GAS COOLING SYSTEM AND METHOD

CLAIM OF PRIORITY

This application claims the benefit of U.S. Provisional Application No. 63/495,681, filed Apr. 12, 2023, the contents of which are hereby incorporated by reference.

FIELD OF THE DISCLOSURE

The present disclosure relates generally to systems and methods for providing refrigeration using cryogenic gases and, more particularly, to systems and methods that precool cryogenic gases using a cryogenic precooling loop.

BACKGROUND

Liquid natural gas (LNG) precooling for air separation and liquefaction of hydrogen and other cryogenic gases is known in the art. In many cases, the LNG is evaporated in a heat exchanger to precool nitrogen in a nitrogen cooling cycle.

In hydrogen liquefaction applications, the nitrogen cooling cycle then typically provides precooling (for example, down to approximately −190° C.) of the hydrogen gas being liquefied. The precooled hydrogen gas is then further cooled and liquefied in one or more additional cooling cycles (for example, down to approximately −253° C.), typically using a hydrogen or helium refrigerant. As a result, the typical process of liquefaction uses a high amount of energy. Furthermore, the process may include multiple refrigeration cycles and involve multiple stages of gas compression.

Since the natural gas resulting from evaporation of LNG it typically used in subsequent processes, the pressure of evaporation of the LNG is often kept sufficiently high, for example above 3 bara. At this pressure, the boiling temperature of LNG is 126.7 K. The boiling temperature of the LNG rises even higher at higher pressures (for example, 144.2 K at 8 bara). Such high boiling temperatures limit the cooling provided by the evaporation of the LNG.

Improvements in efficiency with regard to use of cryogenic fluids, such as LNG and nitrogen, in precooling loops are desirable.

SUMMARY OF THE DISCLOSURE

There are several aspects of the present subject matter which may be embodied separately or together in the methods, devices and systems described and claimed below. These aspects may be employed alone or in combination with other aspects of the subject matter described herein, and the description of these aspects together is not intended to preclude the use of these aspects separately or the claiming of such aspects separately or in different combinations as set forth in the claims appended hereto.

In one aspect, a system for precooling a second cryogenic fluid using a first cryogenic fluid includes a precool heat exchanger system including a primary warming passage, a secondary warming passage and at least one cooling passage. The primary warming passage is configured to receive a stream of first cryogenic fluid for warming a second cryogenic fluid in the at least one cooling passage. A first splitter is configured to receive a first cryogenic fluid stream and to divide the first cryogenic fluid stream into a motive stream and a secondary cooling stream. An ejector has an ejector inlet, an ejector outlet and a suction port. The ejector inlet is configured to receive the motive stream from the first splitter. An expansion device is configured to receive and expand the secondary cooling stream from the first splitter and to direct at least a portion of an expanded secondary cooling stream to the secondary warming passage of the precool heat exchanger system so that a second cryogenic fluid in the at least one cooling passage of the heat exchanger system is cooled. The secondary warming passage of the precool heat exchanger system is in fluid communication with the suction port of the ejector so that first cryogenic fluid from the secondary warming passage is directed into the suction port of the ejector and the pressure within the secondary warming passage is reduced. A primary separation device has a primary separation device inlet, a primary separation device vapor outlet and a primary separation device liquid outlet. The primary separation device inlet is in fluid communication with the ejector outlet and divides a first cryogenic fluid mixed phase stream into a first cryogenic fluid vapor stream that exits the primary separation device through the primary separation device vapor outlet and a liquid recycle stream that exits the primary separation device through the primary separation device liquid outlet. A recycle pump has a pump inlet in fluid communication with the primary separation device liquid outlet and a pump outlet configured to direct first cryogenic fluid to the first splitter.

In another aspect, a method for precooling a second cryogenic fluid using a first cryogenic fluid includes the steps of dividing a first cryogenic fluid stream into a motive stream and a secondary cooling stream; directing the motive stream to an ejector having a suction port; expanding the secondary cooling stream; cooling a second cryogenic fluid using at least a portion of the expanded secondary cooling stream so that a warmed first cryogenic fluid is formed; directing the warmed first cryogenic into the suction port of the ejector; separating a first cryogenic fluid mixed phase stream from an outlet of the ejector into a vapor stream and a liquid recycle stream; pumping at least a portion of the liquid recycle stream for use as the first cryogenic fluid stream in the first step.

In still another aspect, a system for liquefying a cryogenic gas feed stream includes a first precool heat exchanger, a second precool heat exchanger, a liquefier heat exchanger, a natural gas precool refrigeration circuit, a nitrogen precool refrigeration circuit and a primary refrigeration circuit.

The natural gas precool refrigeration circuit includes a liquid natural gas warming passage of the first precool heat exchanger configured to receive and warm a liquid natural gas feed stream. A first precool expansion device is configured to receive a fluid stream from the liquid natural gas warming passage of the first precool heat exchanger. A first precool separation device has a first precool separation device vapor outlet configured to direct fluid to an inlet of a natural gas warming passage of the first precool heat exchanger. The first precool separation device also has a first precool separation device liquid outlet and is configured to receive and separate a fluid stream from the first precool expansion device so that a natural gas vapor stream exits the first precool separation device vapor outlet and a liquid natural gas stream exits the first precool separation device liquid outlet. A second precool expansion device is configured to receive a liquid natural gas stream from the first precool separation device liquid outlet and direct an expanded fluid stream to an inlet of an expanded fluid warming passage of the first precool heat exchanger. A first precool compressor has an inlet in fluid communication with an outlet of the expanded fluid warming passage of the first precool heat exchanger so as to lower the pressure within the expanded fluid warming passage.

The nitrogen precool refrigeration circuit includes a nitrogen cooling passage of the first heat exchanger. A third precool expansion device is configured to receive and expand a fluid stream from the nitrogen cooling passage of the first heat exchanger. A second precool separation device has an inlet configured to receive an expanded fluid from the third precool separation device, a second precool separation device vapor outlet and a second precool separation device liquid outlet. The second precool separation device is configured to receive and separate a fluid stream from the third precool expansion device so that a nitrogen vapor stream exits the second precool separation device vapor outlet and a liquid nitrogen stream exits the second precool separation device liquid outlet. The second precool heat exchanger has a liquid nitrogen warming passage configured to receive and warm a liquid nitrogen stream from the second precool separation device liquid outlet. The first precool heat exchanger has a nitrogen vapor warming passage having an inlet in fluid communication with outlets of the liquid nitrogen warming passage of the second precool heat exchanger and the second precool separation device vapor outlet. A nitrogen compression and cooling system has an inlet in fluid communication with an outlet of the nitrogen vapor warming passage and an outlet in fluid communication with the nitrogen cooling passage of the first heat exchanger.

The primary refrigeration circuit includes a first primary refrigerant precooling passage in the first precool heat exchanger and a second primary refrigerant precooling passage in the second precool heat exchanger with each configured to receive and precool a stream of primary refrigerant. A primary refrigerant adsorber is configured to receive a precooled primary refrigerant stream from the second primary refrigerant precooling passage of the second precool heat exchanger. A liquefier primary refrigerant cooling passage of the liquefier heat exchanger is configured to receive a primary refrigerant stream from the primary refrigerant adsorber. A first primary refrigerant expander has an inlet in fluid communication with the primary refrigerant cooling passage and is configured to receive a first portion of a primary refrigerant flowing through the primary refrigerant cooling passage. The first primary refrigerant expander has an outlet configured to direct expanded primary refrigerant to a first liquefier primary refrigerant warming passage of the liquefier heat exchanger. A first primary refrigerant expansion device has an inlet configured to receive a second portion of primary refrigerant from the first liquefier primary refrigerant cooling passage and an outlet in fluid communication with a second liquefier primary refrigerant warming passage of the liquefier heat exchanger. A first precool primary refrigerant warming passage of the first precool heat exchanger is configured to receive and warm a primary refrigerant stream from the first liquefier primary refrigerant warming passage. A second precool primary refrigerant warming passage of the first precool heat exchanger is configured to receive and warm a secondary refrigerant stream from the second liquefier primary refrigerant warming passage. A primary refrigerant compression and cooling system has a first inlet in fluid communication with an outlet of the first precool primary refrigerant warming passage and a second inlet in fluid communication with an outlet of the second precool primary refrigerant warming passage. The primary refrigerant compression and cooling system also has an outlet configured to direct primary refrigerant to the inlet of the first primary refrigerant precooling passage in the first precool heat exchanger.

The first precool heat exchanger includes a first cryogenic fluid precooling passage configured to receive and cool a cryogenic feed gas stream. The second precool heat exchanger includes a second cryogenic fluid precooling passage configured to receive and cool a cryogenic feed gas stream from the first cryogenic fluid precooling passage. A precool adsorber has an inlet configured to received precooled cryogenic fluid from the second cryogenic fluid precooling passage from the second precool heat exchanger. A first cryogenic fluid cooling passage of the first liquefier heat exchanger is in fluid communication with the precool adsorber and is configured to cool cryogenic fluid therein. A first liquefier adsorber is configured to receive cryogenic fluid from the first cryogenic fluid cooling passage. A second cryogenic fluid cooling passage of the first liquefier heat exchanger is configured to receive and cool cryogenic fluid from the first liquefier adsorber. A second liquefier adsorber is in fluid communication with the second cryogenic fluid cooling passage.

DETAILED DESCRIPTION OF EMBODIMENTS

Figure 1:
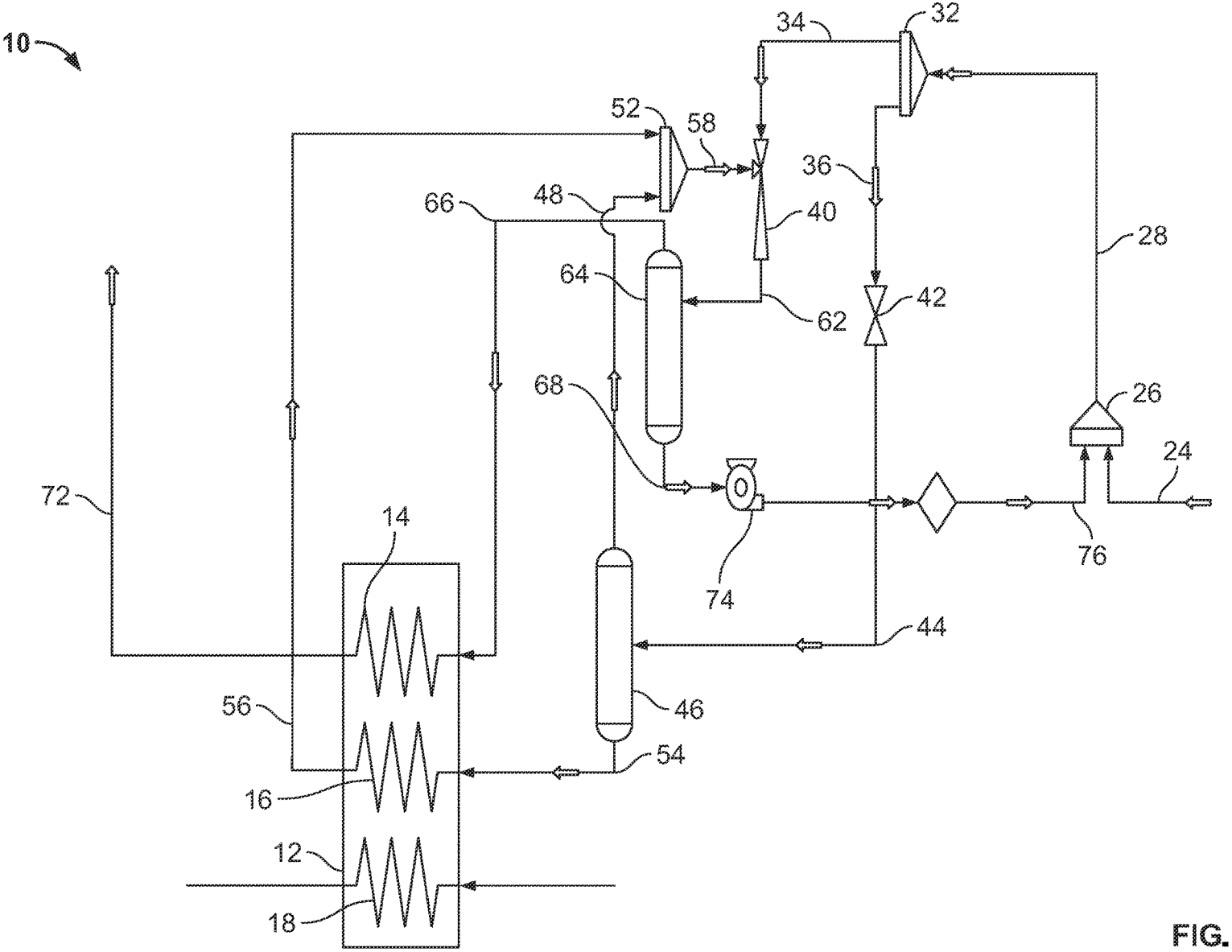
FIG. 1 is a schematic illustration of a first embodiment of the system of the disclosure.

A more detailed description of the system and method in accordance with the present disclosure is set forth below. It should be understood that the description below of specific systems and methods is intended to be exemplary, and not exhaustive of all possible variations or applications. Thus, the scope of the disclosure is not intended to be limiting and should be understood to encompass variations or embodiments that would occur to persons of ordinary skill.

It should be noted herein that the lines, conduits, piping, passages and similar structures and the corresponding streams are sometimes both referred to by the same element number set out in the figures.

The terms "gas" and "vapor" are used interchangeably in the following description.

The term "warming passage" is used below in connection with a heat exchanger to refer to a passage wherein the entering fluid is warmed. The term "cooling passage" is used below in connection with a heat exchanger to refer to a passage wherein an entering fluid is cooled.

Reference numerals that are introduced in the specification in association with a drawing figure may be repeated in one or more subsequent figures for shared elements or components without additional description in the specification in order to provide context for other features.

In the claims, letters are used to identify claimed steps (e.g. a., b. and c.). These letters are used to aid in referring to the method steps and are not intended to indicate the order in which the claimed steps are performed, unless and only to the extent that such order is specifically recited in the claims.

While the separators or separation devices are illustrated as drums in the figures, the separators or separation devices referenced below may alternatively be, but are not limited to, another type of vessel, a cyclonic separator, a distillation unit, a coalescing separator, a mesh or vane type mist eliminator or any other separation device known in the art. In addition, any type of mixer or splitter devices known in the art may be used as the mixers and splitters referenced below.

While the embodiments described below reference systems and methods for providing cooling for a hydrogen gas liquefier, the technology of the disclosure may be used to provide cooling in air separation processes or systems or other types of processes or systems where cooling by a cryogenic fluid is needed.

In accordance with embodiments of the disclosure, the boiling of a first cryogenic fluid, such as liquid natural gas or nitrogen, to precool a second cryogenic fluid, such as nitrogen or hydrogen, can be improved when an ejector is added to the precooling loop with the first cryogenic fluid used as a motive stream and a partial stream of the first cryogenic fluid is reduced in pressure and used to provide precooling of the second cryogenic fluid with the help of the ejector, as will now be described.

With reference to FIG. 1, an embodiment of the system of the disclosure is indicated in general at 10. A precool heat exchanger system includes a precool heat exchanger 12 including primary and secondary warming passages 14 and 16 for a first cryogenic fluid, which is LNG/natural gas in the illustrated embodiment. In addition, the precool heat exchanger 12 includes a cooling passage 18 for a second cryogenic fluid, which is nitrogen in the illustrated embodiment.

The number of cooling and warming passages illustrated for precool heat exchanger 12 may be varied from what is shown in FIG. 1, and the precool heat exchanger system may take the form of a single heat exchanger (as shown in FIG. 1) or alternatively multiple precool heat exchangers.

In the embodiment illustrated in FIG. 1, the first cryogenic fluid (LNG/natural gas) is used to precool the second cryogenic fluid (nitrogen) and the precooled second cryogenic fluid may be used, for example, to precool hydrogen gas prior to liquefaction in one or more downstream heat exchanger(s) using a refrigerant such as hydrogen or helium.

As is known in the art, hydrogen liquefaction may require additional components and/or processing steps, such as purification (by, as an example only, an adsorption system) and ortho-para conversion. While such components and processing steps are not illustrated or described herein, they are well known to persons of skill in the art and their implementation is not impacted by the technology of the disclosure.

With continued reference to FIG. 1, an LNG feed stream enters system 10 at 24 and flows into mixer 26 and then as part of stream 28 to splitter 32 wherein stream 28 is divided into streams 34 and 36. As an example only, splitter 32 may divide approximately 90% of stream 28 into stream 34 and approximately 10% of stream 28 into stream 36.

Stream 34 is directed as the motive stream to an ejector 40.

Stream 36 is directed through an expansion device, such as Joule-Thomson (JT) valve 42, resulting in partially condensed stream 44, which has a lowered boiling point. Alternative types of expansion devices may be used in place of JT valve 42 including alternative types of expansion valves, turbines, orifices or any other type of expansion device known in the art.

Stream 44 is directed to a reduced pressure (such as below atmospheric) separation device 46, where it is separated into secondary vapor and liquid phase streams. The vapor port of the separation device 46 directs a stream 48 to the suction port of the ejector 40 through mixer 52. As a result, suction is applied to the vapor port of the separation device 46 to provide a reduced pressure in the separation device 46.

LNG stream 54 flows from the separation device through the precool heat exchanger 12 wherein it is warmed by heat transfer at least to a nitrogen stream flowing through cooling passage 18. LNG stream 54 is vaporized in secondary warming passage 16 with the resulting natural gas stream 56 flowing to mixer 52, where it is combined with natural gas stream 48 so that mixed natural gas stream 58 is received by the suction port of the ejector 40. As a result, suction is applied to the secondary warming passage 16 of the precool heat exchanger 12 to provide a reduced pressure therein that corresponds to the reduced pressure, and corresponding lower boiling point, of LNG stream 54.

The warming and vaporizing of stream 54 takes away some load from the nitrogen cycle that includes cooling passage 18 of the precool heat exchanger 12. As a result, the size of the compressors of the nitrogen cycle may be reduced, resulting in both lower system equipment and energy costs.

The motive LNG stream 34 is expanded and cooled so that a mixed phase stream 62 exits the ejector 40 and travels to primary separation device 64, where it is divided into natural gas stream 66 and LNG recycle stream 68. Natural gas stream 66 is directed through primary warming passage 14 of precool heat exchanger 12 where it is warmed while cooling the nitrogen stream flowing through passage 18. The resulting warmed natural gas stream exits the system 10 as stream 72.

After exiting separation device 64, LNG recycle stream 68 is pumped by recycle pump 74 to form stream 76 which joins LNG feed stream 24 in mixer 26.

Example stream temperatures and pressures for the LNG and natural gas streams of the system of FIG. 1 are provided in the following Table 1:

TABLE 1

Example stream temperatures and pressures for FIG. 1

| Stream | Phase | Temperature (° K) | Pressure (kPa) |
|---|---|---|---|
| 24 | Liquid | 148.9 | 1000 |
| 28 | Liquid | 119.5 | 1000 |
| 34 | Liquid | 111 | 26.3 |
| 36 | Liquid | 119.5 | 1000 |
| 44 | Mixed | 101.7 | 41.3 |
| 48 | Vapor | 101.7 | 41.3 |
| 54 | Liquid | 101.7 | 41.3 |
| 56 | Vapor | 112.3 | 26.3 |
| 58 | Vapor | 111 | 26.3 |
| 62 | Mixed | 113.4 | 117.6 |
| 66 | Vapor | 113.4 | 117.6 |
| 72 | Vapor | 297.4 | 102.6 |
| 68 | Liquid | 113.4 | 117.6 |
| 76 | Liquid | 113.9 | 1001 |

Figure 2:
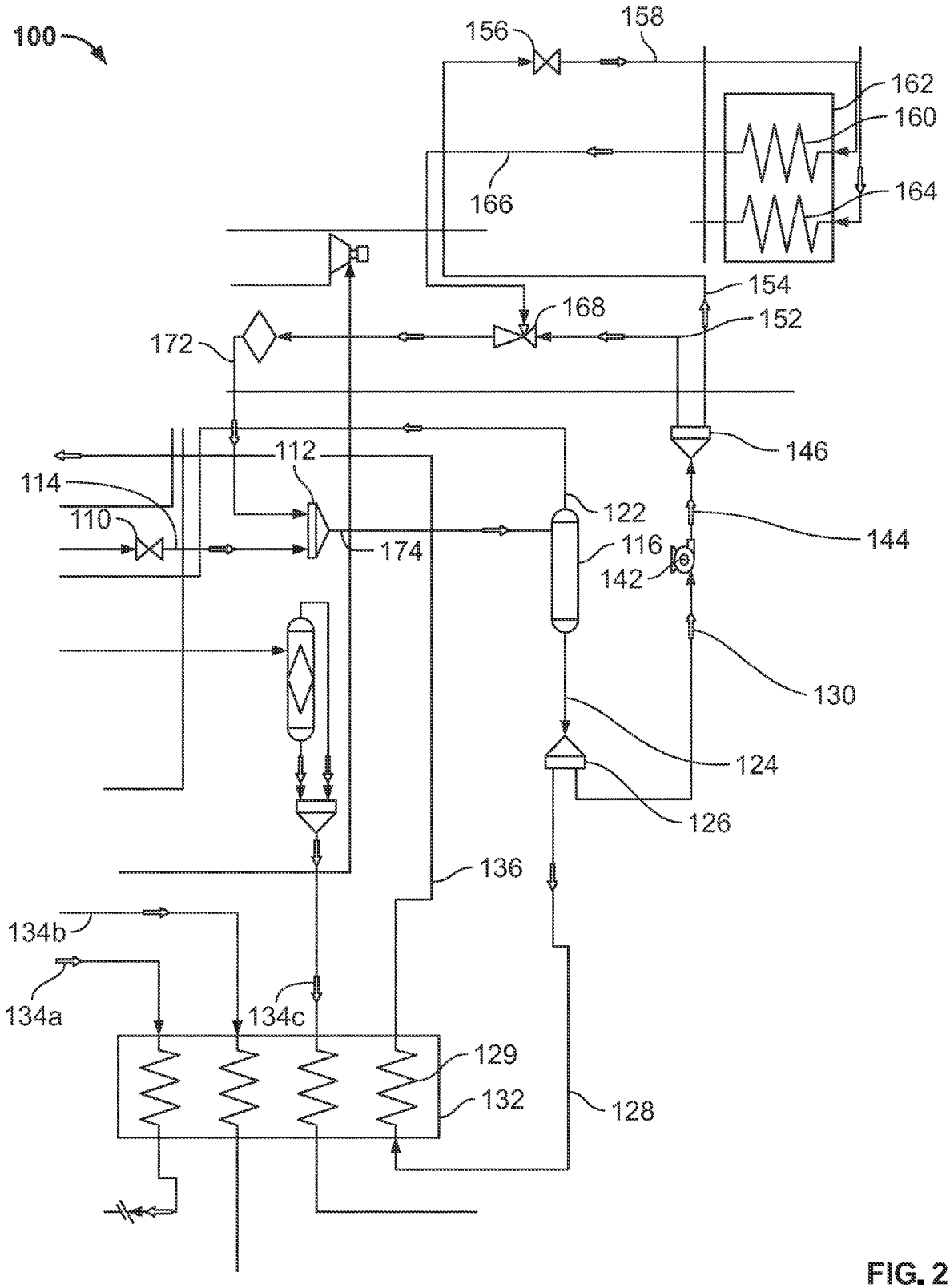
FIG. 2 is a schematic illustration of a second embodiment of the system of the disclosure.

In an alternative embodiment of the disclosure, indicated in general at 100 in FIG. 2, the liquid natural gas cooling is omitted and the technology is used to precool a nitrogen stream which may be used, for example, in precooling of a hydrogen gas stream for a hydrogen liquefaction system or for an alternative cryogenic fluid in an alternative process. More specifically, with reference to FIG. 2, a first cryogenic fluid stream, such as a nitrogen feed stream, flows through an expansion device, such as JT valve 110, and enters mixer 112 as stream 114 before flowing into a primary separation device 116. A resulting nitrogen vapor stream 122 exits the top of separation device 116 for use as described below. As an example only, primary separation device 116 may operate at atmospheric pressure.

Alternative types of expansion devices may be used in place of JT valve 110 including alternative types of expansion valves, turbines, orifices or any other type of expansion device known in the art.

A liquid nitrogen recycle stream 124 exits the bottom of separation device 116 and is divided by splitter 126 into stream 128 and stream 130. As an example only, 90% of stream 124 may exit splitter 126 as stream 128, while 10% of stream 124 may exit splitter 126 as stream 130.

Stream 128 is directed to a primary warming passage 129 of first precool heat exchanger 132 of a precool heat exchanger system where it is used to provide cooling for a second cryogenic fluid stream which may be, for example, hydrogen gas streams 134*a*, 134*b* and 134*c* flowing through corresponding cooling passages of heat exchanger 132. A resulting warmed nitrogen gas stream 136 exits first precool heat exchanger 132 and may be directed to a mixer (not shown) for combination with stream 122. The resulting combined stream may be directed to the warming passage of a heat exchanger (not shown) for cooling a hydrogen stream, with a resulting warmed nitrogen stream directed to a JT valve and a series of compressors and after coolers for conditioning. The JT valve permits smaller and less expensive compressors to be used so as to provide lower system equipment and energy costs.

Liquid nitrogen stream 130, after exiting splitter 126, is pumped via recycle pump 142 as liquid nitrogen stream 144 to another splitter 146 where it is divided into streams 152 and 154. As an example only, 90% of stream 144 exits splitter 146 as stream 152 while 10% of stream 144 exits splitter 146 as stream 154.

Liquid nitrogen stream 154 is expanded through an expansion device, such as JT valve 156, to form a mixed phase nitrogen stream 158 that is, as an example only, approximately half-atmospheric pressure, therewith reducing the boiling point of stream 158 to about 70° K. Stream 158 is directed to a secondary warming passage 160 in a second precool heat exchanger 162 of the precool heat exchanger system where it is warmed to reduce the temperature of, for example, a hydrogen gas stream flowing through cooling passage 164. This takes away some load from the nitrogen cooling cycle and a downstream cooling cycle that further cools and liquefies the hydrogen flowing through cooling passage 164. As a result, the size of the compressors of the downstream cooling cycle, and any compressors (not shown) used in the nitrogen cooling cycle, may be reduced, resulting in both lower system equipment and energy costs.

Nitrogen gas exits the heat exchanger 162 as stream 166 and is received by the suction port of an ejector 168. As a result, suction is provided in the line carrying stream 166 and the pressure within the secondary warming passage 160 of second precool heat exchanger 162 is reduced to correspond to the reduced pressure, and corresponding lower boiling point, of nitrogen stream 158.

Alternative types of expansion devices may be used in place of JT valve 156 including alternative types of expansion valves, turbines, orifices or any other type of expansion device known in the art.

The number of cooling and warming passages illustrated for first and second precool heat exchangers 132 and 162 may be varied from what is shown in FIG. 2, and the precool heat exchanger system may instead take the form of a single precool heat exchanger or alternatively more than two precool heat exchangers.

Liquid nitrogen stream 152 flows to the inlet of ejector 168 as the motive stream. A mixed phase stream 172 exits the ejector 168 and travels to mixer 112 where it is joined with nitrogen gas feed stream 110 before flowing as stream 174 to primary separation device 116.

Example stream temperatures and pressures for the nitrogen streams of the system of FIG. 2 are provided in the following Table 2:

TABLE 2

Example stream temperatures and pressures for FIG. 2

| Stream | Phase | Temperature (° K) | Pressure (kPa) |
|---|---|---|---|
| 114 | Vapor | 78.07 | 110.1 |
| 124 | Liquid | 78.07 | 110.1 |
| 122 | Vapor | 78.07 | 110.1 |
| 128 | Liquid | 78.07 | 110.1 |
| 136 | Vapor | 78.07 | 110.1 |
| 130 | Liquid | 78.07 | 110.1 |
| 144 | Liquid | 78.59 | 1200 |
| 152 | Liquid | 78.59 | 1200 |
| 154 | Liquid | 78.59 | 1200 |
| 158 | Mixed | 69.88 | 37.85 |
| 166 | Vapor | 77.5 | 22.85 |
| 172 | Mixed | 78.07 | 110.1 |
| 174 | Mixed | 78.07 | 110.1 |

Figure 3:
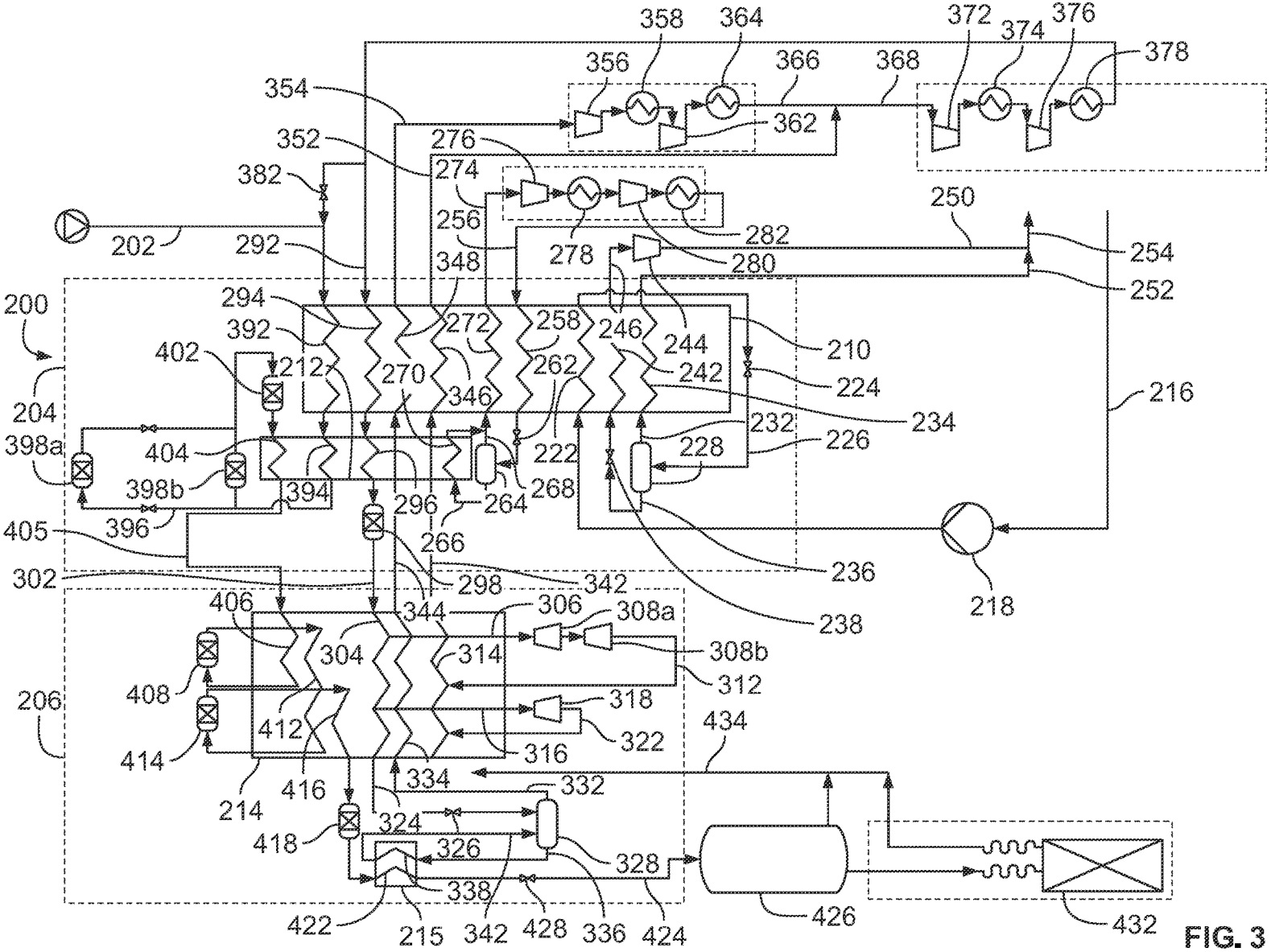
FIG. 3 is a schematic illustration of a third embodiment of the system of the disclosure.

A third embodiment of the system of the disclosure is indicated in general at 200 in FIG. 3 and is configured to liquefy a hydrogen gas feed stream 202 using nitrogen, natural gas and hydrogen refrigerants. While the system is described in terms of liquefying hydrogen gas, it may alternatively be used to liquefy a different cryogenic gas. In this system, the ejector of previous embodiments has been omitted. Furthermore, as explained in greater detail below, the system of FIG. 3 uses a Joule-Thomson (JT) valve for a nitrogen refrigerant cycle. In addition, as further explained below, the system of FIG. 3 uses a natural gas vacuum pump as part of the liquid natural gas cooling circuit.

The system of FIG. 3 features a precooling cold box 204 and a liquefaction or liquefier cold box 206 for insulating the components positioned therein from ambient temperatures. The construction of such cold boxes is well known in the art. The precooling cold box contains a first precool heat exchanger 210 and a second precool heat exchanger 212. As examples only, the first and second precool heat exchangers may be brazed aluminum heat exchangers (BAHXs). While two precool heat exchangers are illustrated, there may alternatively be a single precool heat exchanger or more than two precool heat exchangers. Liquefaction cold box 206 houses first and second liquefaction or liquefier heat exchangers 214 and 215. While two liquefaction heat exchangers are illustrated in FIG. 3, there may instead be one or more than two liquefaction heat exchanger(s).

The nitrogen, natural gas and hydrogen refrigerants provide precooling for the hydrogen gas feed stream 202 in the precooling cold box 204, while the hydrogen refrigerant stream provides cooling for the precooled hydrogen gas feed stream in the liquefaction cold box 206.

A stream of liquid natural gas (LNG) 216 is transferred to the first precool heat exchanger 210 using pump 218. The pumped LNG stream is warmed in first LNG warming passage 222 of heat exchanger 210 and then expanded via expansion device 224, which, as an example only, may be a JT valve. As an example only, the LNG stream 216 may originate from one or more tanks at a temperature of −162° C. (the boiling point of pure Methane at atmospheric pressure), is pumped to 10 bar pressure by pump 218 and then prewarmed and partially evaporated at −124.5° C. in first LNG warming passage 222 of the first precool heat exchanger 210. The following JT valve 224 returns the temperature of the stream back to −160° C. with further evaporation.

A mixed phase stream 226 exits JT valve 224 and enters a subsequent separation device or phase separator 228, with a resulting vapor stream 232 being directed to a natural gas warming passage 234 of first precool heat exchanger 210. An LNG stream 236 exits the phase separator 228 and is directed to a JT valve (or other expansion device) with the resulting stream directed to expanded fluid warming passage 242 of the first precool heat exchanger 210. A vacuum pump compressor 244 allows evaporation of liquid in passage 242 at, as an example only, 430-280 mbar at −171° C. In some embodiments, this evaporation may take most of the heat load in the first precool heat exchanger 210. The vacuum compressor pressurizes the natural gas stream 246 exiting passage 242 back to atmospheric conditions. The natural gas streams 250 and 252 exiting the compressor 244 and passage 234, respectively, are combined into stream 254, which exits the system for further use elsewhere.

Additional cooling in the first and second precool heat exchangers of FIG. 3, such as for the system adsorbers presented below, may be provided by a liquid nitrogen cooling cycle. A nitrogen feed stream 256, which is at least partially liquid, is further cooled in nitrogen cooling passage 258 of the first precool heat exchanger 210. The cooled stream is then expanded in a JT valve 262, with the resulting expanded stream directed to separation device 264. A liquid stream 266 exits the bottom of the separation device 264 and is warmed in the liquid nitrogen warming passage 270 of the second precool heat exchanger 212 to provide cooling therein. The resulting nitrogen vapor stream exits passage 270 and joins a nitrogen vapor stream 268 exiting the top of separation device 264. The combined nitrogen vapor stream then travels through nitrogen vapor warming passage 272 of the first heat exchanger 210 where it is warmed to provide cooling therein. The resulting warmed nitrogen vapor stream 274 exits passage 272 and is compressed in a first nitrogen compressor 276 followed by cooling in first nitrogen aftercooler 278, further compression in second nitrogen compressor 280 and then after cooling in second nitrogen after cooler 282. As a result, nitrogen feed stream 256 is formed. As examples only, the compressors 280 and 282 may be screw compressors. In alternative embodiments, a single or more than two nitrogen compressor and aftercooler stage(s) may be employed. Furthermore, in alternative embodiments, the JT valve 262 may be replaced by a different expansion device, such as a compander.

Cooling is provided in the first and second liquefaction heat exchangers 214 and 215 by a primary refrigerant including hydrogen in a primary refrigeration circuit. In addition, supplemental cooling is provided in the first and second precool heat exchangers by the primary refrigerant circuit.

In the primary refrigeration circuit, a hydrogen refrigerant stream 292 flows through the first and second primary refrigerant precooling passages 294 and 296 of first and second precool heat exchangers 210 and 212 where it is cooled via the nitrogen and LNG/NG refrigeration circuits described above. The cooled hydrogen fluid stream exiting passage 296 then travels through adsorber 298 and exits the precool cold box 204 as stream 302. The continuously circulating refrigerant has a reduced risk of carrying/picking up contaminants. For this reason, it is possible during short periods of regeneration of the adsorber to operate the system without it.

Stream 302 enters the liquefier cold box 206 and is further cooled in primary refrigerant cooling passage 304 of liquefaction heat exchanger 214. A first primary refrigerant branch 306 directs a portion of the hydrogen refrigerant stream 302 to first and second primary refrigerant expanders 308*a* and 308*b* with the resulting expanded stream 312 directed back into the first primary refrigerant warming passage 314 of the first liquefier heat exchanger 214. The remaining portion of stream 302 is directed through a further portion of primary refrigerant cooling passage 304 for further cooling. A second primary refrigerant branch 316 directs a portion of the hydrogen refrigerant stream to a third primary refrigerant expander 318 with the resulting expanded stream 322 directed back into the first primary refrigerant warming passage 314 of the first liquefier heat exchanger 214. The hydrogen refrigerant is warmed within the primary refrigerant warming passage of the first liquefier heat exchanger 214 to provide refrigeration therein.

While expansion turbines 308*a*, 308*b* and 318 are illustrated in FIG. 3, a single turbine pass or additional turbine passes, with intervening heat exchanger passes, may be used instead. In addition, alternative types of expansion devices including, but not limited to, expansion valves may be used in place of the turbines.

The hydrogen refrigerant remaining in primary refrigerant cooling passage 304 after branches 306 and 316 is further cooled and exits the passage 304 as stream 324, which is then expanded via JT valve 326 (or any other type of expansion device), with the resulting expanded stream directed to separation device 328. A vapor stream 332 exits the separation device 328 and is directed through a second primary refrigerant warming passage 334 whereby further cooling is provided in the liquefier heat exchanger 214. A liquid hydrogen refrigerant stream 336 exits the separation device 328 and enters liquid hydrogen warming passage 338 of second liquefier heat exchanger 215 to provide cooling therein. The resulting at least partially vaporized hydrogen refrigerant stream exiting passage 338 is directed to separation device 328.

Streams 312, 322 and 332 cooperate to provide the refrigeration required to liquefy precooled hydrogen stream 202 in the liquefier cold box 206. For example, the temperature of the hydrogen gas stream 202 may be reduced to approximately 20° K-22° K in the cold end of the liquefier cold box 206.

The streams 342 and 344 exiting first and second primary refrigerant warming passages 314 and 334, respectively, of first liquefier heat exchanger 214 are directed through first and second precool hydrogen warming passages 346 and 348 in first precool heat exchanger 210 to provide a portion of the refrigeration therein. The resulting hydrogen gas streams 352 and 354 exit the precool cold box 204.

Hydrogen refrigerant vapor stream 354 travels through a first primary compressor 356, a first primary aftercooler 358, a second primary compressor 362 and a second primary after cooler 364 of the primary refrigeration circuit to form medium pressure vapor stream 366. Hydrogen refrigerant vapor stream 352 joins medium pressure vapor stream 366 to form combined hydrogen refrigerant vapor stream 368, which is directed through a third primary compressor 372, a third primary aftercooler 374, a fourth primary compressor 376 and a fourth primary after cooler 378 to form high pressure hydrogen refrigerant stream 292. A portion of hydrogen refrigerant stream 292 may be directed into hydrogen vapor feed stream 202 by manipulation of valve 382 to provide initial cooling of stream 202.

As illustrated in FIG. 3, a gaseous hydrogen feed stream 202 enters the precool cold box 204 and passes through first and second hydrogen precooling passages 392 and 394 of first and second precool heat exchangers 210 and 212, respectively where, as explained in greater detail below, it is cooled. The cooled stream 396 then passes through adsorbers 398*a*, 398*b* and 402. The adsorber(s) functions to remove any type of impurity from the hydrogen fluid stream. The adsorber includes a specific material in which the impurities will be bonded to or absorbed into the material. In one embodiment, the adsorber can be comprised of a carbon, specifically an activated carbon material, but also zeolites are used.

The purified hydrogen gas stream exiting the adsorber 402 then travels again through third hydrogen precooling passage 404 of second precool heat exchanger 212 as a second pass where it is further cooled to approximately 80° K or less (as an example only).

The cooled second pass stream 405 then enters liquefier cold box 206 and flows through a first hydrogen liquefier cooling passage 406 of first liquefier heat exchanger 214. The resulting cooled hydrogen stream flows through first liquefier adsorber 408, which directs the exiting hydrogen stream to a second hydrogen liquefier cooling passage 412. The further cooled hydrogen stream exiting passage 412 is directed to a second liquefier adsorber 414, which directs an exiting hydrogen stream to a third hydrogen liquefier cooling passage 416. The entirely or partially liquefied hydrogen stream exiting passage 416 travels to a third liquefier adsorber 418. The hydrogen stream exiting third liquefier adsorber 418 is further cooled or subcooled in cooling fourth hydrogen liquefier cooling passage 422 of second liquefier heat exchanger 215, with the resulting liquid hydrogen stream 424 traveling to hydrogen storage vessel 426. The line carrying stream 424 may optionally include a JT valve 428 (or other product expansion device) for cooling the stream. Vapor from both hydrogen storage vessel 426 and a tanker truck 432 is vented via vent line 434.

Any of the hydrogen precooling passages of first and second precool heat exchangers 210 and 212 and/or hydrogen liquefier cooling passages of first and second liquefier heat exchangers 214 and/or 215 may contain an ortho-para conversion catalyst that converts ortho-hydrogen to para-hydrogen to reduce volatilization. Such a conversion catalyst may alternatively be placed in any of the adsorbers or in stand alone devices.

As indicated previously, the number of heat exchangers, and the number of adsorbers, illustrated may be varied from what is shown in FIG. 3.

While the preferred embodiments of the disclosure have been shown and described, it will be apparent to those skilled in the art that changes and modifications may be made therein without departing from the spirit of the disclosure, the scope of which is defined by the following claims.

What is claimed is:

1. A system for precooling a second cryogenic fluid using a first cryogenic fluid comprising:

a. a precool heat exchanger system including a primary warming passage, a secondary warming passage and at least one cooling passage, said primary warming passage configured to receive a stream of first cryogenic fluid for warming a second cryogenic fluid in the at least one cooling passage;

b. a first splitter configured to receive a first cryogenic fluid stream and to divide the first cryogenic fluid stream into a motive stream and a secondary cooling stream;

c. an ejector having an ejector inlet, an ejector outlet and a suction port, said ejector inlet configured to receive the motive stream from the first splitter;

d. an expansion device configured to receive and expand the secondary cooling stream from the first splitter and to direct at least a portion of an expanded secondary cooling stream to the secondary warming passage of the precool heat exchanger system so that a second cryogenic fluid in the at least one cooling passage of the heat exchanger system is cooled;

e. said secondary warming passage of the precool heat exchanger system in fluid communication with the suction port of the ejector so that first cryogenic fluid from the secondary warming passage is directed into the suction port of the ejector and the pressure within the secondary warming passage is reduced;

f. a primary separation device having a primary separation device inlet, a primary separation device vapor outlet and a primary separation device liquid outlet, said primary separation device inlet in fluid communication with the ejector outlet and to divide a first cryogenic fluid mixed phase stream into a first cryogenic fluid vapor stream that exits the primary separation device through the primary separation device vapor outlet and a liquid recycle stream that exits the primary separation device through the primary separation device liquid outlet;

g. a recycle pump having a pump inlet in fluid communication with the primary separation device liquid outlet and a pump outlet configured to direct first cryogenic fluid to the first splitter.

2. The system of claim 1 wherein said primary warming passage of the heat exchanger system is in fluid communication with the primary separation device vapor outlet and configured to receive and warm the vapor stream from the primary separation device so that a second cryogenic fluid in the at least one cooling passage of the heat exchanger system is cooled.

3. The system of claim 1 further comprising a second splitter configured to receive the liquid recycle stream from the primary separation device liquid outlet and to divide the liquid recycle stream into a first portion that is received by the recycle pump and a second portion wherein said primary warming passage of the heat exchanger system is configured to receive and warm the second portion of the liquid recycle stream so that a second cryogenic fluid in the at least one cooling passage of the heat exchanger system is cooled.

4. The system of claim 1 further comprising a first mixer configured to receive a liquid recycle stream from the recycle pump and a first cryogenic liquid feed stream so that a combined first cryogenic liquid stream is formed and directed to the first splitter.

5. The system of claim 1 wherein that at least one cooling passage is a single cooling passage and the precool heat exchanger system includes a single precool heat exchanger that includes the primary warming passage, the secondary warming passage and the single cooling passage.

6. The system of claim 1 wherein that at least one cooling passage includes a first cooling passage and a second cooling passage and the precool heat exchanger system includes a first precool heat exchanger including the primary warming passage and the first cooling passage and a second precool heat exchanger including the secondary warming passage and the second cooling passage.

7. The system of claim 1 wherein the first cryogenic fluid includes liquid natural gas and the second cryogenic fluid includes nitrogen.

8. The system of claim 1 wherein the first cryogenic fluid includes nitrogen and the second cryogenic fluid includes hydrogen.

9. The system of claim 1 wherein the expansion device is a Joule-Thomson valve.

10. The system of claim 1 wherein the primary separation device is configured to operate at atmospheric pressure.

11. The system of claim 10 further comprising a reduced pressure separation device and a third mixer, said reduced pressure separation device configured to receive the expanded secondary cooling stream from the expansion device and to separate the expanded secondary cooling stream into a secondary liquid stream and a secondary vapor stream, wherein said secondary liquid stream is directed to the secondary warming passage of the precool heat exchanger system and the secondary vapor stream is directed to the third mixer, said third mixer configured to also receive warmed first cryogenic fluid from the secondary warming passage of the precool heat exchanger system and direct a resulting mixed stream to the suction port of the ejector.

12. The system of claim 1 further comprising a second mixer configured to receive a first cryogenic fluid mixed phase stream from the ejector outlet and a first cryogenic liquid feed stream so that a combined first cryogenic liquid stream is formed and directed to the primary separation device.

13. A method for precooling a second cryogenic fluid using a first cryogenic fluid comprising the steps of:

a. dividing a first cryogenic fluid stream into a motive stream and a secondary cooling stream;
b. directing the motive stream to an ejector having a suction port;
c. expanding the secondary cooling stream;
d. cooling a second cryogenic fluid using at least a portion of the expanded secondary cooling stream so that a warmed first cryogenic fluid is formed;
e. directing the warmed first cryogenic into the suction port of the ejector;
f. separating a first cryogenic fluid mixed phase stream from an outlet of the ejector into a vapor stream and a liquid recycle stream;
g. pumping at least a portion of the liquid recycle stream for use as the first cryogenic fluid stream in step a.

14. The method of claim 13 wherein the first cryogenic fluid includes liquid natural gas and the second cryogenic fluid includes nitrogen.

15. The method of claim 13 wherein the first cryogenic fluid includes nitrogen and the second cryogenic fluid includes hydrogen.

16. The method of claim 13 wherein the expanding during step c. is accomplished using a Joule-Thomson valve.

17. The method of claim 13 wherein the vapor stream of step f. is warmed to cool the second cryogenic fluid stream.

18. The method of claim 13 further comprising the step of mixing the pumped liquid recycle stream of step g. with a first cryogenic liquid feed stream to form the first cryogenic fluid stream of step a.

19. The method of claim 13 wherein a portion of the liquid recycle stream of step f. is warmed to cool the second cryogenic fluid stream.

20. The method of claim 13 further comprising the step of mixing the first cryogenic fluid mixed phase stream from an outlet of the ejector with a first cryogenic fluid prior to the separation of step f.

21. A system for liquefying a cryogenic gas feed stream comprising:

a. a first precool heat exchanger;
b. a second precool heat exchanger;
c. a liquefier heat exchanger;
d. a natural gas precool refrigeration circuit including:
  i) a liquid natural gas warming passage of the first precool heat exchanger configured to receive and warm a liquid natural gas feed stream;
  ii) a first precool expansion device configured to receive a fluid stream from the liquid natural gas warming passage of the first precool heat exchanger;
  iii) a first precool separation device having first precool separation device vapor outlet configured to direct fluid to an inlet of a natural gas warming passage of the first precool heat exchanger, said first precool separation device also having a first precool separation device liquid outlet and configured to receive and separate a fluid stream from the first precool expansion device so that a natural gas vapor stream exits the first precool separation device vapor outlet and a liquid natural gas stream exits the first precool separation device liquid outlet;
  iv) a second precool expansion device configured to receive a liquid natural gas stream from the first precool separation device liquid outlet and direct an expanded fluid stream to an inlet of an expanded fluid warming passage of the first precool heat exchanger;
  v) a first precool compressor having an inlet in fluid communication with an outlet of the expanded fluid warming passage of the first precool heat exchanger so as to lower the pressure within the expanded fluid warming passage;
e. a nitrogen precool refrigeration circuit comprising:
  i) a nitrogen cooling passage of the first heat exchanger;
  ii) a third precool expansion device configured to receive and expand a fluid stream from the nitrogen cooling passage of the first heat exchanger;
  iii) a second precool separation device having an inlet configured to receive an expanded fluid from the third precool separation device, a second precool separation device vapor outlet and a second precool separation device liquid outlet, said second precool separation device configured to receive and separate a fluid stream from the third precool expansion device so that a nitrogen vapor stream exits the second precool separation device vapor outlet and a liquid nitrogen stream exits the second precool separation device liquid outlet;
  iv) said second precool heat exchanger having a liquid nitrogen warming passage configured to receive and warm a liquid nitrogen stream from the second precool separation device liquid outlet;
  v) said first precool heat exchanger having a nitrogen vapor warming passage having an inlet in fluid communication with outlets of the liquid nitrogen warming passage of the second precool heat exchanger and the second precool separation device vapor outlet;
  vi) a nitrogen compression and cooling system having an inlet in fluid communication with an outlet of the nitrogen vapor warming passage and an outlet in fluid communication with the nitrogen cooling passage of the first heat exchanger;

f. a primary refrigeration circuit including:

i) a first primary refrigerant precooling passage in the first precool heat exchanger and a second primary refrigerant precooling passage in the second precool heat exchanger each configured to receive and precool a stream of primary refrigerant;

ii) a primary refrigerant adsorber configured to receive a precooled primary refrigerant stream from the second primary refrigerant precooling passage of the second precool heat exchanger;

iii) a liquefier primary refrigerant cooling passage of the liquefier heat exchanger configured to receive a primary refrigerant stream from the primary refrigerant adsorber;

iv) a first primary refrigerant expander having an inlet in fluid communication with the primary refrigerant cooling passage and configured to receive a first portion of a primary refrigerant flowing through the primary refrigerant cooling passage, said first primary refrigerant expander having an outlet configured to direct expanded primary refrigerant to a first liquefier primary refrigerant warming passage of the liquefier heat exchanger;

v) a first primary refrigerant expansion device having an inlet configured to receive a second portion of primary refrigerant from the first liquefier primary refrigerant cooling passage and an outlet in fluid communication with a second liquefier primary refrigerant warming passage of the liquefier heat exchanger;

vi) a first precool primary refrigerant warming passage of the first precool heat exchanger configured to receive and warm a primary refrigerant stream from the first liquefier primary refrigerant warming passage and a second precool primary refrigerant warming passage of the first precool heat exchanger configured to receive and warm a secondary refrigerant stream from the second liquefier primary refrigerant warming passage;

vii) a primary refrigerant compression and cooling system having a first inlet in fluid communication with an outlet of the first precool primary refrigerant warming passage and a second inlet in fluid communication with an outlet of the second precool primary refrigerant warming passage and an outlet configured to direct primary refrigerant to the inlet of the first primary refrigerant precooling passage in the first precool heat exchanger;

g. said first precool heat exchanger including a first cryogenic fluid precooling passage configured to receive and cool a cryogenic feed gas stream and said second precool heat exchanger including a second cryogenic fluid precooling passage configured to receive and cool a cryogenic feed gas stream from the first cryogenic fluid precooling passage;

h. a precool adsorber having an inlet configured to received precooled cryogenic fluid from the second cryogenic fluid precooling passage from the second precool heat exchanger;

i. a first cryogenic fluid cooling passage of the first liquefier heat exchanger in fluid communication with the precool adsorber and configured to cool cryogenic fluid therein;

j. a first liquefier adsorber configured to receive cryogenic fluid from the first cryogenic fluid cooling passage;

k. a second cryogenic fluid cooling passage of the first liquefier heat exchanger configured to receive and cool cryogenic fluid from the first liquefier adsorber;

l. a second liquefier adsorber in fluid communication with the second cryogenic fluid cooling passage.

22. The system of claim 21, further comprising precool cold box within which the precool heat exchanger is positioned and a liquefier cold box within which the liquefier heat exchanger is positioned.

23. The system of claim 21 wherein the first precool expansion device, the second precool expansion device, the third precool expansion device and the first primary refrigerant expansion devices are Joule-Thompson valves.

24. The system of claim 21 wherein the primary refrigerant is hydrogen.

25. The system of claim 21 further comprising:

m. a liquefier primary refrigerant separation device having a first inlet configured to receive a primary refrigerant stream from the first primary refrigerant expansion device and an outlet in fluid communication with the second liquefier primary refrigerant warming passage of the liquefier heat exchanger;

n. a second liquefier heat exchanger having a liquid primary refrigerant warming passage and a cryogenic fluid cooling passage, said liquid primary refrigerant warming passage configured to receive and warm a primary refrigerant liquid stream from the liquefier primary refrigerant separation device and said cryogenic fluid cooling passage configured to receive and cool a cryogenic fluid stream from the second liquefier adsorber;

o. said primary refrigerant warming passage of the second liquefier heat exchanger configured to direct warmed primary refrigerant to a second inlet of the liquefier primary refrigerant separation device.

26. The system of claim 25 further comprising:

p. a product expansion device configured to receive and expand cryogenic fluid from the cryogenic fluid cooling passage of the second liquefier heat exchanger;

q. a cryogenic liquid storage vessel configured to receive a stream of cryogenic liquid from the product expansion device.

27. The system of claim 26 wherein the product expansion device is a Joule-Thomson valve.

28. The system of claim 21 wherein the cryogenic feed gas stream is hydrogen gas.

29. The system of claim 21 further comprising a branch valve having an inlet in fluid communication with the outlet of the primary refrigerant compression and cooling system and an outlet in fluid communication with the inlet of the first cryogenic fluid precooling passage so that a portion of the primary refrigerant may be selectively directed to the first cryogenic fluid precooling passage of the first precool heat exchanger.

30. The system of claim 21 further comprising a liquid natural gas pump configured to pump liquid natural gas to the liquid natural gas warming passage of the first precool heat exchanger.

31. The system of claim 21 wherein the first primary refrigerant expander is a turbine.

32. The system of claim 21 wherein each of the nitrogen compression and cooling system and the primary refrigerant compression and cooling system includes multiple compressor and aftercooler stages.

* * * * *